US006394172B1

(12) United States Patent
Kessous

(10) Patent No.: US 6,394,172 B1
(45) Date of Patent: May 28, 2002

(54) TRACKLESS ROLL-UP DOOR OPENING COVERING

(76) Inventor: Jacques Kessous, 392 N. Fullerton Ave., Upper Montclair, NJ (US) 07043

( * ) Notice: Subject to any disclaimer, the term of this patent is extended or adjusted under 35 U.S.C. 154(b) by 0 days.

(21) Appl. No.: 09/746,131

(22) Filed: Dec. 22, 2000

(51) Int. Cl.[7] ..... A47G 5/02
(52) U.S. Cl. ..... 160/264; 160/290.1
(58) Field of Search ..... 160/310, 23.1, 160/133, 267.1, 266, 290.1, 264, 903, 383, 387, 26, DIG. 11

(56) References Cited

U.S. PATENT DOCUMENTS 3,006,352 A * 10/1961 Hozak ..... 160/264 X
3,089,540 A * 5/1963 Schwartz ..... 160/26 X
3,292,685 A * 12/1966 Clark ..... 160/264 X
5,046,544 A 9/1991 Coluccio
5,123,474 A * 6/1992 Smith ..... 160/310
5,203,395 A * 4/1993 Koller et al. ..... 160/263
5,921,305 A * 7/1999 Grudl ..... 160/66
6,065,525 A 5/2000 Wells
6,082,433 A 7/2000 Vafaie et al.
6,152,207 A * 11/2000 Varley ..... 160/264

* cited by examiner

*Primary Examiner*—David M. Purol
(74) *Attorney, Agent, or Firm*—Buchanan Ingersoll, P.C.

(57) ABSTRACT

A trackless roll-up door covering to contain materials within, and prevent animals from entering, a building or enclosure having a large door opening. In one embodiment of the invention an open weave vinyl coated polyester moisture resistant quick drying fabric material is fixedly weighted at a first end and fixedly attached to a tubular assembly at a second end. The tubular assembly is rotated by rotatable drive member, such as a motor, hand crank, spring loaded mechanism, which extends the fabric when operated in a first direction and retracts the fabric when operated in a second direction. Strapping members are used to secure the fabric material when it is extended to loosely close cover the door opening. Additional strapping members are optionally used to further secure the fabric material and prevent bowing in the center of the extended material.

20 Claims, 4 Drawing Sheets

TRACKLESS ROLL-UP DOOR OPENING COVERING

FIELD OF INVENTION

The present invention relates to door opening closures. More particularly, this invention relates to a flexible covering apparatus for large door openings.

BACKGROUND OF INVENTION

Large door openings pose special problems in allowing entry of industrial equipment, such as, trucks, front loader, etc. while preventing the unwanted entry of animals such as birds, deer, etc. For example, road-side buildings housing materials, such as road salt used to de-ice roads, have large openings that lack doors to allow the entry of loaders and trucks to store or extract salt. Such door openings span over twenty feet in width and up to thirty feet in height and provide an adequate area for birds to enter and accumulate in the rafters therein. As is known, the collection of birds in these buildings, and pigeon lofts, and barns, etc, creates conditions that cause serious diseases, such as histoplamosis, in workers in the buildings. This is particular true when the buildings are not used for long periods of time and a large number of birds or other animals have taking up residence therein.

One method of closing these large door openings is by using a standard double hinged door. In this case, typically two doors can be swung open or closed on hinges attached to the sides of the door opening. This method has disadvantages as the door size makes the doors heavy and require a large amount of space to allow the doors to swing freely. In one case, when the doors are swung into the enclosure or building, the area to allow the door to swing open must remain clear. Hence, the door swing occupies valuable space that cannot be used to store materials. In the alternative, if the doors swing outwardly, then in cases of large snowfalls, a significant effort is necessary to clear an area to allow the doors to swing open.

A second method of closing these door openings is by using an overhead door that moves upwardly and is stored near the building ceiling. This type of door is advantageous as no space is lost for accommodating a door swing. However, an overhead door also has disadvantages, as it is extremely large, heavy and requires a track system to guide it into an open or close position. The heavy weight of the overhead door further creates additional problems in physically moving the door upward and downward. In one aspect, the weight of the door requires a significantly large motor to move the door up and down. In another aspect, the size and weight of the door represents a potential safety hazard as the moving door can cause significant injury to personnel caught in the path of a closing door. Hence, a sophisticated control system is needed to prevent a closing door from causing damage or injury. Further still, the tracks used to guide the overhead door into place are susceptible to damage by trucks or equipment operating within the building. For example, damage may occur to the track by a truck contacting a track guide. The track guide can then become mis-aligned or crimped, which can cause the overhead door to not close properly or even become disengaged from the track guide system.

An alternative type of door covering is a roll-up door, which rolls up onto a large roller suspended above the door opening. Roll-up doors typically are fabricated from a plurality of thin metal sheets, such as aluminum, steel, etc., which are hinged together to hang from a large overhead roller. The hinged metal provides flexibility for the metal sheets to collect around the suspended roller. However, while these roll-up type doors may be lighter than an overhead door, as discussed previously, the problem associated with damage to the track guides can also render these doors unfit for proper operation.

Accordingly, there is a need to provide a lightweight covering for a large door opening that allows the entry and exit of large vehicles and prevents the unwanted entry of birds, deer etc., without using a tracking guide system.

SUMMARY OF INVENTION

A trackless, lightweight, flexible door opening covering is disclosed. The flexible door opening covering rolls up and down on a roller mechanism which is rotatably driven by a motor mechanism, a spring loaded mechanism, a hand crank, etc. The flexible door covering is composed of a lightweight material is weighted at one end to allow the fabric to remain substantially taut as it is rolled up onto, or drawn from, the roller mechanism. Gravitation force on the weighted fabric end substantially guides the extending fabric vertically as it is drawn from the roller mechanism. In a preferred embodiment, the lightweight fabric is composed of a high-tensile strength open-weave vinyl material having finished edges. The material prevents animals from entering a building, when it is extended in front of a building opening, while allowing air circulation through the building.

BRIEF DESCRIPTION OF THE FIGURES

The advantages and aspects of the present invention will be more fully understood in conjunction with the following detailed description and accompanying drawings, wherein.

Figure 1A:
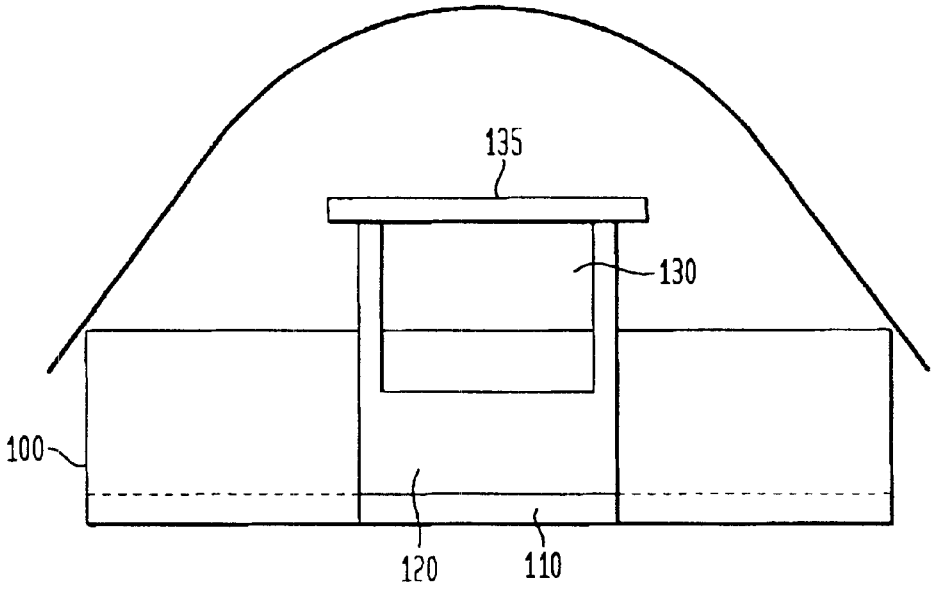
FIG. 1*a* illustrates a frontal view of a large door opening in an industrial enclosure or building depicting an exemplary embodiment of the invention.

It is to be understood that these drawings are solely for purposes of illustrating the concepts of the invention and are not intended as a definition of the limits of the invention. It will be appreciated that the same reference numerals, possibly supplemented with reference characters where appropriate, have been used throughout to identify corresponding parts.

DETAILED DESCRIPTION OF THE INVENTION

Figure 1B:
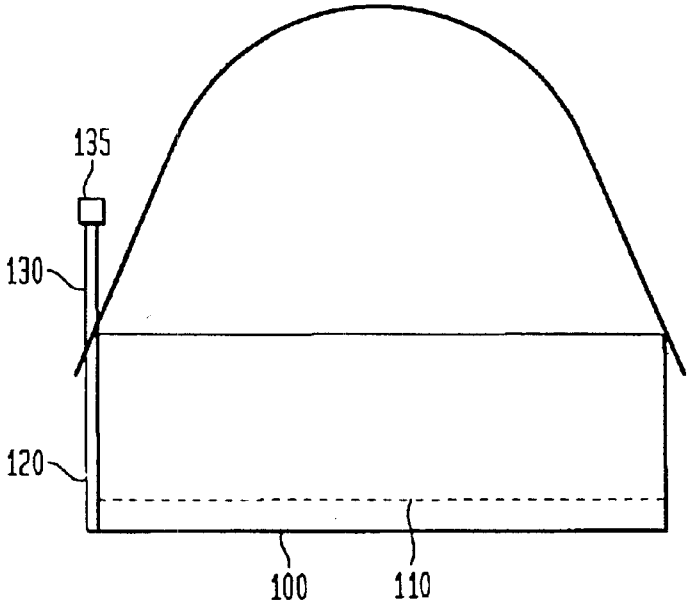
FIG. 1*b* illustrates a side view of a large door opening in an industrial enclosure or building depicting an exemplary embodiment of the invention.

FIGS. 1*a* and 1*b* collective illustrate an exemplary enclosure 100 having flooring 110, which is visible through opening 120. Enclosure 100 may be used to store materials or vehicles, in preparation for their use at a later time. Further, illustrated is an exemplary roll-up covering 130, constructed in accordance with the principles of the invention, suspended beneath roller cover 135, which laterally spans opening 120. In an alternate embodiment, roll-up covering 130 is larger in size than opening 120, for example, by eight inches, and consequently extends beyond opening 120.

In the illustrated example, covering 130 is shown as partially closing opening 120. As would be appreciated, roll-up covering 130 can be drawn upward to fully expose opening 120 or extended downward to fully cover opening 120. In the fully extended position, roll-up covering 130 prevents animals, such as deer, skunks, raccoons, birds, pigeons, etc., from entering building 100, and taking up residence therein.

Figure 2:
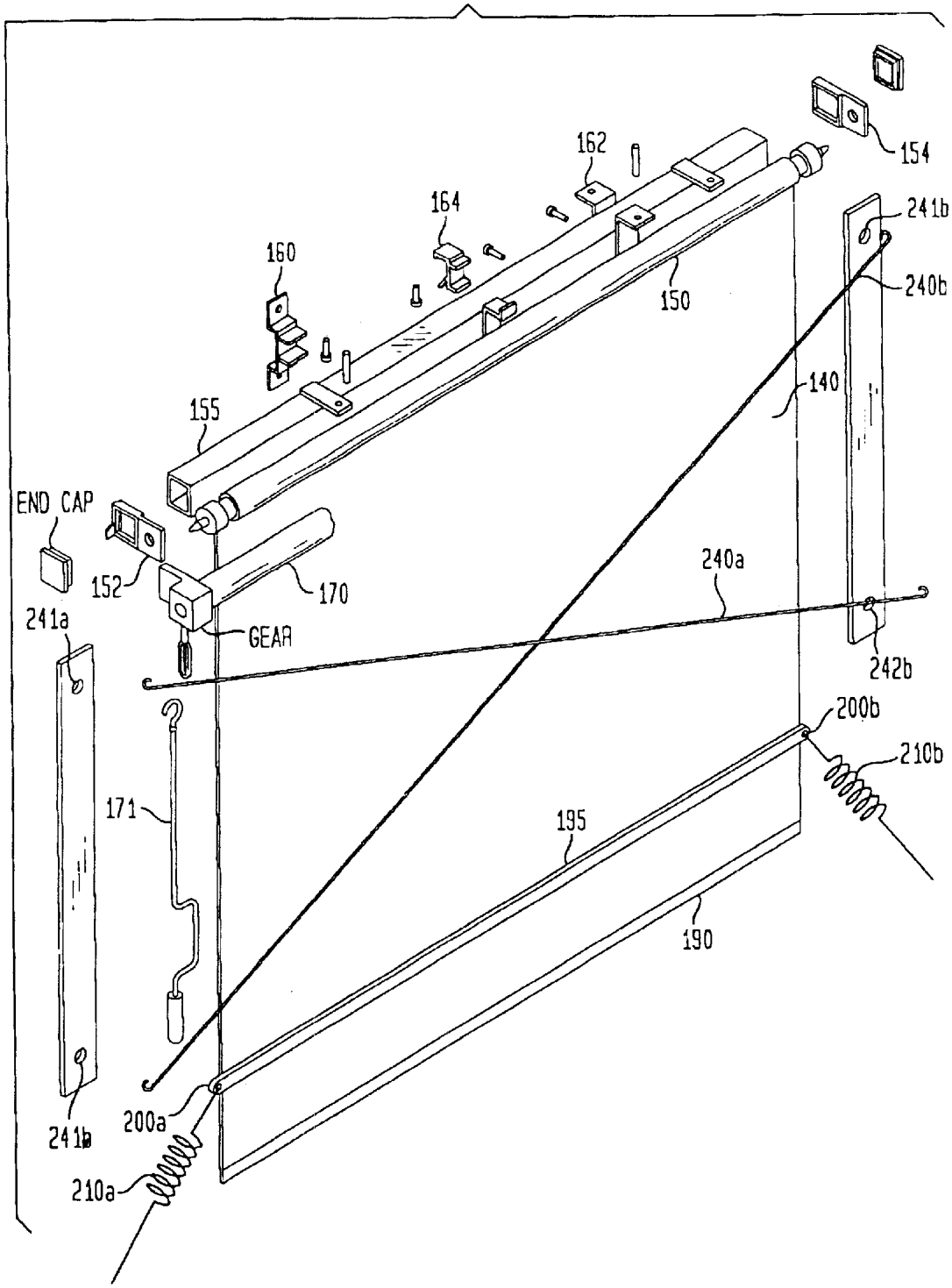
FIG. 2 illustrates a prospective view of an exemplary embodiment of the invention.

FIG. 2 illustrates a detailed prospective view of the roll-up opening cover 130 illustrated in FIGS. 1*a* and 1*b*, without roller cover 135. Fabric 140, which is representative of the material covering opening 120, is suspended from tubular bar 150, which would be covered by roller cover 135 (see FIG. 1*a* and 1*b* ). Tubular bar 150 is supported by and held between a left support bracket 152, and a right support bracket 154, which are attached to respective ends of torsion bar 155. Torsion bar 155 is fixedly to a wall or overhang using left mounting brackets 160 and right mounting bracket 162, and, optionally, by at least one center bracket 164 spaced at a known interval. As shown, left mounting bracket 160 is representative of a wall mounting bracket that is typically attached to a vertical surface. On the other hand, right mounting bracket 162, is representative of a soffit mounting bracket, which is typically attached to a horizontal surface. As would be appreciated by those skilled in the art, the use of wall bracket, i.e., left bracket 160, or soffit mount bracket, i.e., right bracket 162, and optional center bracket 164, depends upon the desired mounting configuration. The number and placement of center brackets, as would be appreciated, depends upon the span of opening 120 and the width of torsion bar 155. In a preferred embodiment, brackets are spaced at two foot intervals.

In one embodiment of the invention, attached at each end of tubular bar 150 are support brackets 152, 154, which retain tubular bar 150 therebetween. Tubular bar 150 is rotatably coupled to support brackets 152, 154 to allow it to freely rotate. In an alternative embodiment support brackets 152, 154 can be attached directed to a mounting surface, for example, a vertical surface on enclosure 100.

Within tubular bar 150 is optionally included motor 170, as illustrated in the enlarged insert drawing of a left end of tubular bar 150. Motor 170 is used to rotate tubular bar 150 such that when motor 170 is rotated in a first direction fabric 140 is drawn around tubular bar 150, i.e., fabric 140 is raised. On the other hand, when motor 170 is rotated in a second direction, fabric 140 is extended from tubular bar 150, consequentially lowering fabric 140 in front of opening 120. Fabric 140 is thus raised and lowered into position without requiring a tracking guide system. Alternatively, hand-crank 171 can be used to raise and lower fabric 140, when motor 170 is unavailable or inoperable. Furthers still, a spring-loaded mechanism (not shown) may be used to raise and lower fabric 140.

Illustrated further is weight bar 190 extending laterally through one end of fabric 140. Weight bat 190 provides a load within fabric 140 which holds fabric 140 substantially taut as fabric 140 is raised and lowered. Optionally, second weight bar 195, extending laterally through fabric 140 is vertically spaced from weight bar 190. Second weight bar 195 further includes at each end, at least one attachment means, illustrated as loop 200*a*, 200*b*, respectively. Attachment means 200*a*, 200*b* can include hooks, eye-hooks, loops, latches, etc. In a second embodiment (not shown), attachments means 200*a*, 200*b*, can be attached directly to fabric 140, independent of the presence of second weight bar 195. Attachment means. 200*a*, 200*b* can be attached to fabric 140, for example, by crimping fabric 140 between extensions on attachment means 200*a*, 200*b* by pressure, fittings, screws, etc.

Fastening straps 210*a*, 210*b* may then be used to secure fabric 140 by attachment means 200*a*, 200*b*, respectively, and attachment means (not shown), which are secured to the surrounding area. Fastening straps 210*a*, 210*b*, can be selected, for example, as string, cord, rope, wire, springs, springs and strap combination, etc. In one embodiment of the invention, fastening straps 210*a*, 210*b* are bungee cords. This combination provides a flexible means to accommodate different distances between attachment means 210*a* and 220*a*, and attachment means (not shown), which are secured to the surrounding area. In one aspect of the invention, fastenings straps 210*a*, 210*b* are composed of a combination of straps and springs. This combination also provides flexibility to accommodate different distances between attachment means.

Further, illustrated are leashing means 240*a*, 240*b*. Leashing means 240*a*, 240*b* are attached to attachment points 241*a*, 241*b* at a first end, respectively, and removably attached to attachment points 242*b*, 242*a*, respectively, at a second end. Attachment points 241*a*, 241*b*, 242*a*. 242*b* are fixedly attached to building 100. In this illustrative example, leashing means 240*a*, 240*b* are diagonally positioned across fabric 140 such that a second end of leashing means 240*a* is attached to attachment point 242*a* and a second end of leashing means 240*b* is attached to attachment 242*b*. In this position, leashing means 240*a*, 240*b* provide additional support in securing fabric 140 by limiting perpendicular movement of fabric 140. In an alternate embodiment, strapping means 240*a* is attached to attachment point 241*a* at a first end and operable to be laterally position across fabric 140 to engage attachment point 241*b* at a second end. Similarly, strapping means 240*b* is attached to attachment point 242*a* at a first end and operable to be laterally positioned across fabric 140 to engage attachment point 242*b* at a second end.

Figure 3:
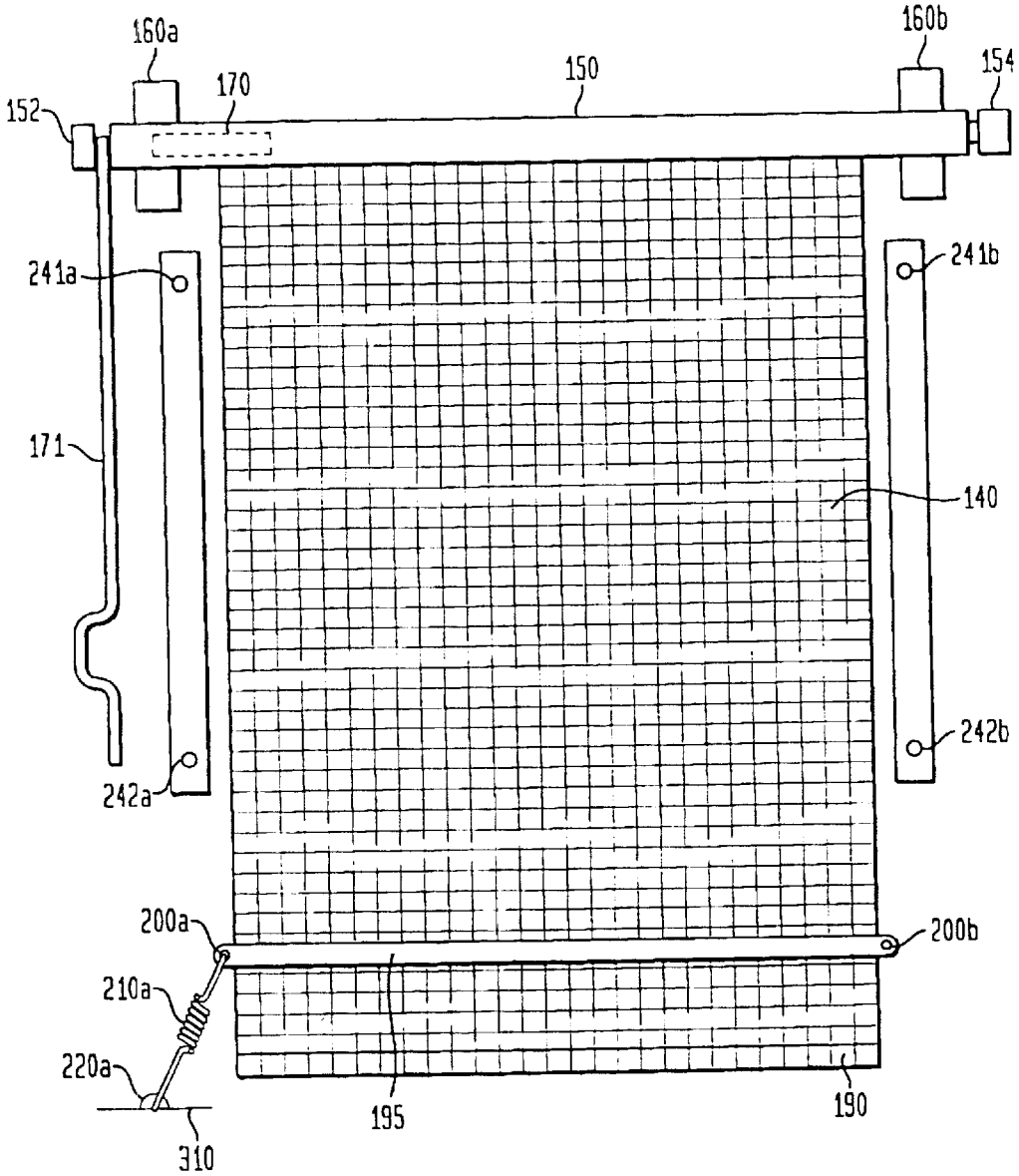
FIG. 3 illustrates a frontal view of the exemplary embodiment of the invention depicted in FIG. 2.

FIG. 3 depicts a frontal view of fabric 140 illustrating a preferred open-weave meshed pattern of fabric 140. In this illustrative example, fabric 140 is formed from a high tensile strength, high tear strength vinyl coated polyester, which is moisture resistant and quick drying. Vinyl coated polyester suitable for use as fabric 140 has a weight in the range of 8–30 ounces per square yard. In a preferred embodiment, fabric 140 has a weight of 12 ounces per square yard. Open weave fabric 140 similarly may be specified by the number of vertical and horizontal threads per square inch. In such a specification, fabric 140 may have a range of 4×4 threads per square inch to 40×40 threads per square inch.

Also illustrated is attachment means 220*a*, which is fixedly attached to a surrounding area. Attachment means 220*a* may be a hook, eye-hook, latch, etc., which is embedded in the Earth, a concrete block, etc., within a known distance from fabric 140. Illustrated further, is fastening strap 210*a* securing fabric 140 by joining attachment means 200*a* with attachment means 220*a*. As would be appreciated, fastening strap 210*b*, similarly joins attachment means 200*b* to attachment means 220*b* (not shown).

Figure 4:
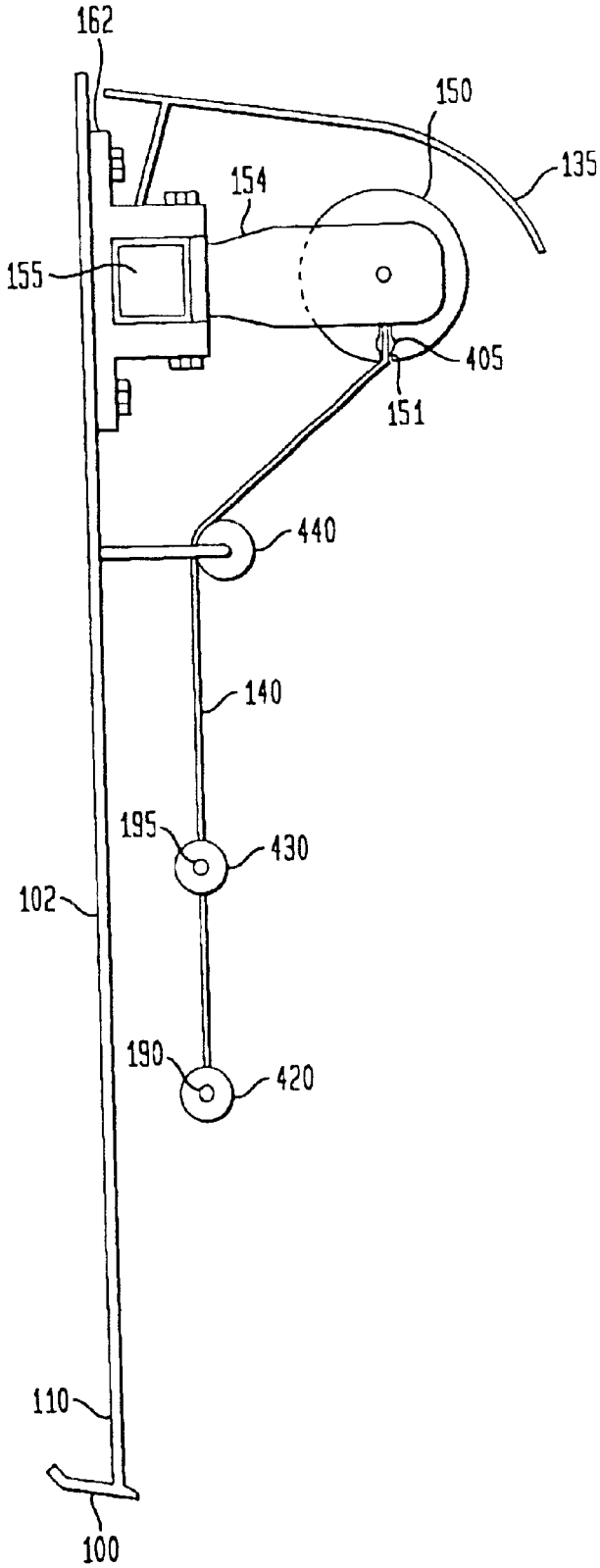
FIG. 4 illustrates a cross-sectional view of the exemplary embodiment of the invention depicted in FIG. 3 through section A—A.

FIG. 4 represents a cross-sectional view of an exemplary attachment of the present invention to a vertical mounting surface. In this exemplary assembly, support bracket 162 is representative of a wall mounted bracket, which is fixedly attached to vertical surface 102 of building 100. Torsion bar 155 is removably attached to support bracket 162. As shown in FIG. 2, a plurality of brackets, i.e., left mounting bracket 160, right mounting bracket 162 and at least one center mounting bracket 164, provide rigid support along the length of torsion bar 155. Support bracket 154 is illustrated as extending outwardly from, and attaching to, one end of torsion bar 155. Support bracket 154 provides support for tubular bar 150 as tubular bar 150 spans opening 120. Further, tubular bar 150 is rotatably coupled to support bracket 154. Tubular 150 is thus able to rotate between support brackets 154 and 152 (not shown) to raise or lower fabric 140.

Fabric 140, in one embodiment of the invention, is attached to tubular bar 150 by first creating a sleeve 405 in a first end fabric 140 and capturing sleeve 405 in slot 153, which traverses tubular bar 150. Sleeve 405 can be created by wrapping a first end of fabric 140 onto itself and applying an adhesive, such as an epoxy to fixedly attach fabric 140 first end. To further secure fabric 140 to tube 150, bar 151 can be slide laterally through captured sleeve 405 to secure fabric 140 within tubular bar 150. In an second embodiment of the invention, fabric 140 may be fixedly attached directly to tubular bar 150 using an adhesive, such as an epoxy.

Weight bar 190, attached to a second end of fabric 140, is used to render fabric 140 substantially taut, as fabric 140 is raised onto, or lowered from, tubular bar 150. Optionally, second weight bar 195, vertically disposed from weight bar 190, may be used to contribute to, or distribute the, weight necessary to retain fabric 140 substantially taut. In this illustrative embodiment, first weight bar 190 and second weight bar 195 are contained within sleeves created by folding fabric 140 onto itself to create sleeves into which the illustrated weigh bars are contained. Weight bar 190, 195 may be of a metal construction, such as stainless steel, zinc, tin, etc. Although illustrated as two separate weights, it would understood that first weight bar 190 and second weight bar 195 may be fixedly joined a known distance apart. In such an embodiment, the combined weight bars provide a semi-solid lower edge to retain the contents of the enclosure therein. Alternatively, first weight bar 190 and second weight bar 195 can be a single solid material. In such an embodiment, the solid material provides a solid lower edge to retain the contents within the enclosure. Optional roller guide 440 shown attached to vertical surface 102 of building 100 retains fabric 140 a known distance from vertical surface 102.

Although the invention has been described and pictured in a preferred form with a certain degree of particularity, it is understood that the present disclosure of the preferred form, has been made only by way of example, and that numerous changes in the details of construction and combination and arrangement of parts may be made without departing from the spirit and scope of the invention as hereinafter claimed. It is intended that the patent shall cover by suitable expression in the appended claims, those features of patentable novelty exist in the invention disclosed.

I claim:

1. A flexible roll up door opening cover apparatus comprising:

an elongated tubular bar suspended at each end by a support bracket across said door opening, said tubular bar being rotatably coupled within said support brackets;

an open-weave fabric attached to said tubular bar at a first end and having at least one weighting element attached at a second end, said weighting element retaining said fabric substantially taut;

means for rotating said tubular bar, wherein said fabric is drawn around said tubular bar when said tubular bar is rotated in a first direction and drawn from said tubular bar when said tubular bar is rotated in a second direction, said fabric length being sufficient to guard said door opening when drawn from said tubular bar;

at least one attachment means positioned laterally to each edge of said fabric, said attachment means attached external to said door opening; and at least one leashing means engaging one of said at least one second attaching means at a first end and at least one opposing second attachment means at a second end.

2. The apparatus as recited in claim 1 further comprising;

a elongated rigid bar suspended across said door opening removably attached to a plurality of mounting brackets fixedly attached to an enclosure surrounding said opening, said rigid bar further attached at each end to one of said support bracket.

3. The apparatus as recited in claim 1 wherein said tubular bar is hollow.

4. The apparatus as recited in claim 1 wherein said tubular bar includes a slot distributed laterally therein.

5. The apparatus as recited in claim 1 wherein said fabric is fixedly attached to said tubular bar using an adhesive.

6. The apparatus as recited in claim 3 wherein said fabric is attached to said tubular bar by capturing said fabric within said slot.

7. The apparatus as recited in claim 6 wherein said fabric is captured within said slot by creating a sleeve laterally along said fabric first end and fitting said first end sleeve in said slot.

8. The apparatus as recited in claim 7 wherein included within said captured first end sleeve is a rod, said rod being of sufficient cross-sectional diameter to retain said first end sleeve within said slot.

9. The apparatus as recited in claim 1 wherein said means for rotating said tubular bar includes a hand-crank assembly.

10. The apparatus as recited in claim 1 wherein said means for rotating said tubular bar includes a motor assembly.

11. The apparatus as recited in claim 10 wherein said motor assembly is included within said tubular bar.

12. The apparatus as recited in claim 10 wherein said motor assembly includes a bi-directional motor.

13. The apparatus as recited in claim 1 wherein said at least one weighting element is attached to said fabric by creating a sleeve laterally in said fabric second end and including said at one weighting element therein.

14. A flexible roll up door opening cover apparatus comprising:

an elongated tubular bar suspended at each end by a support bracket across said door opening, said tubular bar being rotatably coupled within said support brackets;

an open-weave fabric attached to said tubular bar at a first end and having at least one weighting element attached at a second end, said weighting element retaining said fabric substantially taut;

means for rotating said tubular bar, wherein said fabric is drawn around said tubular bar when said tubular bar is rotated in a first direction and drawn from said tubular bar when said tubular bar is rotated in a second direction, said fabric length being sufficient to guard said door opening when drawn from said tubular bar; and wherein at least one of said at least one weighting element includes attachment means, said attachment means used to secure said fabric second end to at least one attachment point external to said apparatus.

15. The apparatus of claim 14 further comprising:

at least one second attachment means positioned laterally to each edge of said fabric, said second attachment means attached external to said door opening; and at least one leashing means engaging one of said at least one second attaching means at a first end and at least one opposing second attachment means at a second end.

16. The apparatus as recited in claim 15 wherein said at least one leashing means is laterally extendable across said fabric.

17. The apparatus as recited in claim 15 wherein said at least one leashing means is diagonally extendable across said fabric.

18. The apparatus as recited in claim 1 wherein said fabric is a vinyl coated polyester.

19. The apparatus as recited in claim 18 wherein said fabric has a weight of in the range of 8 to 30 ounces per square yard.

20. The apparatus as recited in claim 1 wherein said fabric has an open-weave in the range of 4 to 40 vertical and horizontal threads per square inch.

* * * * *